US006530681B2

(12) United States Patent
Sieczkowski

(10) Patent No.: US 6,530,681 B2
(45) Date of Patent: Mar. 11, 2003

(54) SURFACE-MOUNTED DECORATIVE TRIM CEILING FIXTURE

(75) Inventor: Philip Sieczkowski, Lawrenceville, GA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/858,278

(22) Filed: May 15, 2001

(65) Prior Publication Data

US 2002/0191405 A1 Dec. 19, 2002

(51) Int. Cl.[7] ..... F21S 8/06

(52) U.S. Cl. ..... 362/404; 362/365; 362/147; 362/432; 362/260; 362/375; 362/405

(58) Field of Search ..... 362/364, 365, 362/147, 404, 405, 396, 374, 375, 370, 432, 260

(56) References Cited

U.S. PATENT DOCUMENTS 3,130,949 A * 4/1964 Erhardt et al.
3,313,931 A * 4/1967 Klugman
5,727,871 A * 3/1998 Kotloff ..... 362/225

* cited by examiner

*Primary Examiner*—Thomas M. Sember
*Assistant Examiner*—Jacob Y. Choi

(57) ABSTRACT

A ceiling surface-mounted fixture housing capable of supporting decorative trim of differing shapes and sizes and further being capable of surface mounting to ceiling drywall about a recessed junction box mounted in the ceiling or to inverted T-grid ceiling systems, the invention provides flexibility and function and ease of installation. In a preferred embodiment of the invention, a fixture housing having a substantially central aperture formed in a major planar floor thereof is mounted by conventional fasteners over a junction box which has previously been installed in a recess of a drywall ceiling or the like. Wiring for the junction box extends into the fixture housing from the junction box and is joined to wiring carried by a wireway cover which joins mechanically to the fixture housing, the wiring thus being carried within a "box" formed by the fixture housing and the wireway cover. Lamping and ballast are mounted to an exterior major surface of the wireway cover. Hanger bars mounted to the fixture housing receive hook-like mounting brackets which have been mounted to frame portions of a decorative trim in locations which permit easy engagement and disengagement of the mounting brackets with the hanger bars. On assembly, the decorative trim covers the lamping, ballast, etc., to enable the fixture to present a pleasing appearance.

11 Claims, 5 Drawing Sheets

SURFACE-MOUNTED DECORATIVE TRIM CEILING FIXTURE

BACKGROUND OF THE INVENTION

1. Field of the Invention

The invention relates generally to surface-mounted lighting fixtures and particularly to lighting fixtures having a common housing and wiring cover mountable to or about a ceiling-mounted junction box from which wiring is pulled to connect the fixture electrically to mains power, the housing and wiring cover mounting a wide variety of decorative trims of differing sizes and shapes using identical mounting expedients.

2. Description of the Prior Art

Lighting fixtures including fluorescent lighting fixtures have long been mounted to ceilings such as drywall ceilings and inverted T-grid ceilings such that portions of the lighting fixture extend from the plane of the ceiling to provide an operational function, a decorative function or both Certain kinds of fluorescent lighting fixtures are configured to mount to a ceiling in proximity to a junction box which is mounted to the ceiling either in a recessed configuration or in a configuration which is flushly mounted to planar surfaces of the ceiling. When such fluorescent lighting fixtures are decorative fixtures which can include a wide variety of decorative trims of differing sizes and shapes, it becomes desirable to be able to provide lighting fixture structure which will mount directly to the ceiling or to an inverted T-grid ceiling in the vicinity of a junction box for connection to wiring pulled from the junction box, this mounting structure being capable of covering the wiring while mounting ballast and lamping as well as the various examples of the trim itself while hiding the wiring, lamping, ballast, etc. In other words, the art has felt a need for a lighting fixture having essentially identical structure which permits electrical connection to a recessed junction box or the like in a ceiling and which covers wiring pulled from the junction box to connect wiring present on the fixture and which further mounts lamping and ballast as well as fixture trim of differing type, all of the components of the fixture being essentially identical with the exception of the trim itself. Such a lighting fixture would thus provide a mounting platform which would be substantially identical from fixture to fixture but which would be capable of mounting decorative trim of widely varying description such that the mounting platform portions of the fixture would be identical throughout an installation within which the decorative trim varied widely. It would thus appear to a user of an environmental space within which the fixture of the invention was utilized that a variety of lighting fixtures were provided when only the trims per se might vary between fixtures. Of course, it would be possible to utilize the same decorative trim in each lighting fixture depending upon considerations of aesthetics and lighting design. It is to be understood that the decorative trim used with the lighting fixture mounting platform of the invention can be of virtually any conventional shape including circular, oval, square, rectangular, etc. It is further to be understood that the mounting platform of the present lighting fixture is structured to allow a portion thereof to be directly mounted to a ceiling with a second portion of the platform then being mounted for pivoting motion relative to the ceiling-stabilized portion of the fixture which has already been affixed to the ceiling, thereby facilitating the connection of wiring and subsequent closure of the platform once wiring connections have been made.

The mounting platform of the present lighting fixtures is therefore seen to be easily installed due in part to simplified structure which facilitates mounting near to a junction box for connection to mains power and also for mounting decorative trim in spaced relation to a ceiling for decorative effect.

SUMMARY OF THE INVENTION

The invention provides a lighting fixture particularly capable of being surface mounted to a ceiling such as a dry wall ceiling or an inverted T-grid ceiling, the lighting fixture of the invention including a mounting platform formed of a fixture housing which mates with a wireway cover to contain wiring within an enclosure formed by the combination of the housing and the cover. The mounting platform thus formed by the combination of the housing and the cover provides a surface on which lamping, ballast and the like can be provided and hidden from view by the mounting to the platform of a variety of decorative trims of differing size and shape, the decorative trims being mounted to bar hanger structures which mount to the platform. In this manner, essentially the same mounting platform structure can be used to connect to wiring from a ceiling-recessed junction box or the like. Further, an essentially identical mounting platform can mount ballast, lamping and the like and also carry pivoting bar hangers which mount any one of a variety of decorative trims, the trims hiding the mounting platform and associated lamping, ballast, etc. while providing a pleasing appearance such as the appearance of a trim floating below the ceiling since the trim can be mounted in spaced relation to the ceiling without any visible means of support.

The particular structure of the present mounting platform allows rapid installation of the lighting fixture with a minimum of skill being required. Beginning with either a ceiling-recessed junction box having appropriate wiring extending therethrough or with the structure of an inverted T-grid as a ceiling, a fixture housing element substantially formed of a planar plate having an enlarged central aperture formed therein is mounted to the ceiling such as by screws, toggle bolts, etc., depending upon the ceiling structure available for mounting. Wiring is pulled from the junction box through the central aperture of the fixture housing and connected to wiring available on an inner side of a wireway cover which mounts ballast and lamping. However, prior to connection of the wiring from the junction box to the wiring from the wireway cover, the wireway cover is mounted along one major edge to a major edge of the fixture housing for pivoting movement such that the wireway cover is positively held in place during the wiring procedure. Once wiring is accomplished, the wireway cover is pivoted to a mating position with the fixture housing and affixed to the housing to form an enclosure within which the wiring is disposed. Lamping is then mounted to the downwardly disposed, major planar surface of the wireway cover by the expedient of conventional lamp holders and the like. The fixture housing and the wireway cover are held together through the simple expedient of appropriate mechanical fasteners such as screws. Hanger bars of substantially U-shape are mounted for pivotal motion at each end of the mounting platform thus formed, the hanger bars receiving mounting brackets appropriately positioned on and fastened to a frame of a trim which is to be mounted by the platform, the ability of the hanger bars to pivot facilitating reception of the hook-like mounting brackets to the hanger bars. A trim, which typically mounts a diffuser centrally within a frame, is particularly intended with use of the present mounting platform to be spaced from the ceiling surface about the periphery of the frame in order to give a desired "floating" effect and thus to cause the fixture to present a pleasing appearance.

Accordingly, it is an object of the invention to provide a lighting fixture having a mounting platform particularly intended to mount to a ceiling formed of drywall or an inverted T-grid ceiling, the fixture including a mounting platform capable of attachment to a ceiling such as about a J-box to allow wiring of the fixture to wiring from the J-box and to mount lamping, ballast and the like as well as any one of a variety of decorative trim which can be substituted for use with the mounting platform depending upon the exigencies of a given lighting installation.

It is another object of the invention to provide a mounting platform for a ceiling surface-mounted lighting fixture whereby one portion of a mounting platform is affixed to the ceiling such as about a J-box recessed into the ceiling and a mating portion of the mounting platform is capable of being carried by the fixed portion of the platform and being capable of pivotal motion relative thereto in order to quickly and easily enclose wiring once connected by the simple expedient of pivoting an outward portion of the mounting platform relative to the fixed portions of the mounting platform, thereby to facilitate installation of a lighting fixture configured with the present mounting platform as a major portion thereof.

It is a further object of the invention to provide a lighting fixture particularly capable of surface-mounting to a ceiling and including a mounting platform capable of hiding and/or mounting wiring, lamping, ballast and the like and further carrying on pivoting hanger bars mounted to the platform a variety of decorative trim which include hook-like mounting brackets which are received on the pivotal of the pivoting hanging bars, the decorative trim being capable of mounting with a frame spaced from ceiling surfaces and with the fixture having no apparent means of support, thereby producing a "floating" fixture having a pleasing visual appearance.

Further objects and advantages of the invention will become more readily apparent in light of the following detailed description of the preferred embodiments.

DESCRIPTION OF THE PREFERRED EMBODIMENTS

Figure 1:
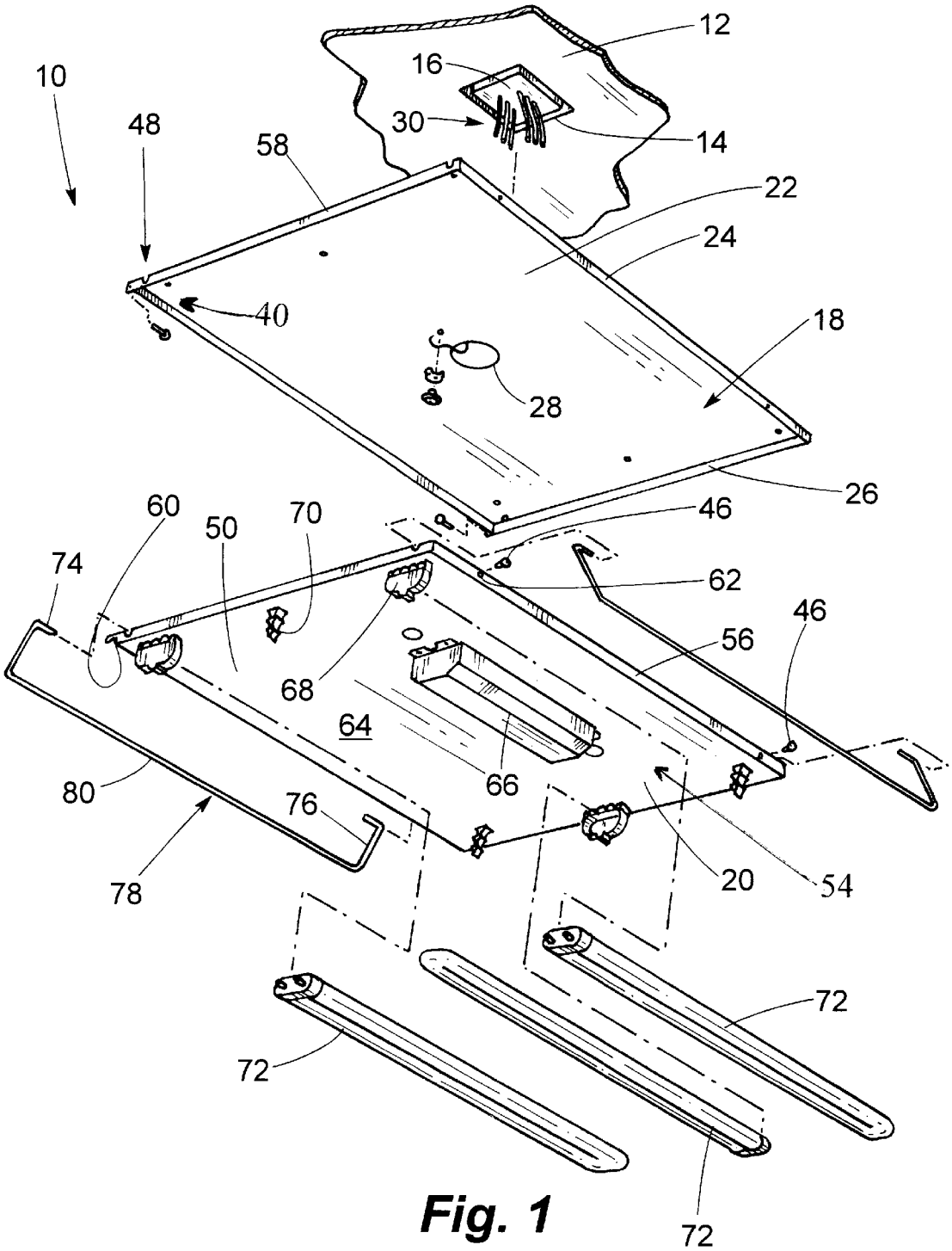
FIG. 1 is an exploded in perspective of component parts of the invention which on assembly form a mounting platform.

Referring now to the drawings and particularly to FIG. 1, components of a mounting platform 10 configured according to the invention are seen to be in an exploded assembly arrangement relative to a ceiling 12 having a recess 14 formed therein which receives a junction box 16 or similar electrical box therewithin. The junction box 16 can be flushly mounted within the recess 14 with visible surfaces of the ceiling 12. Alternatively, the junction box 16 can be placed up into the recess 14 or can even extend from the recess 14 in the event a particular application requires such an arrangement. The mounting platform 10 of the invention as well as the lighting fixture of the invention can be utilized with inverted T-grid ceiling systems (not shown) as an example. However, description of the invention relative to installation in a ceiling 12 such as is formed of drywall or the like is adequate to an understanding of the invention.

Figure 2:
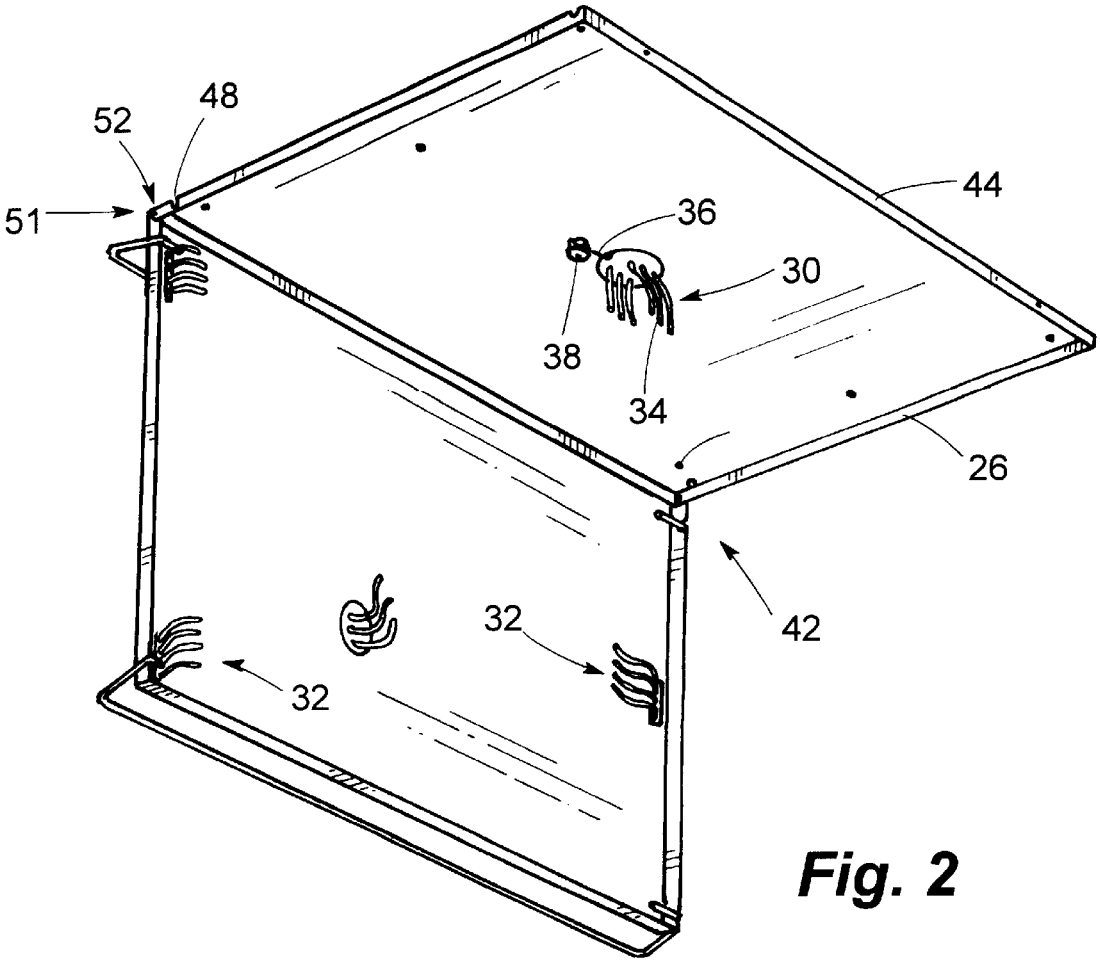
FIG. 2 is a perspective view of the mounting platform of the invention with one portion of the platform hanging from a second portion of the platform which is positively connected to a ceiling.
Figure 3:
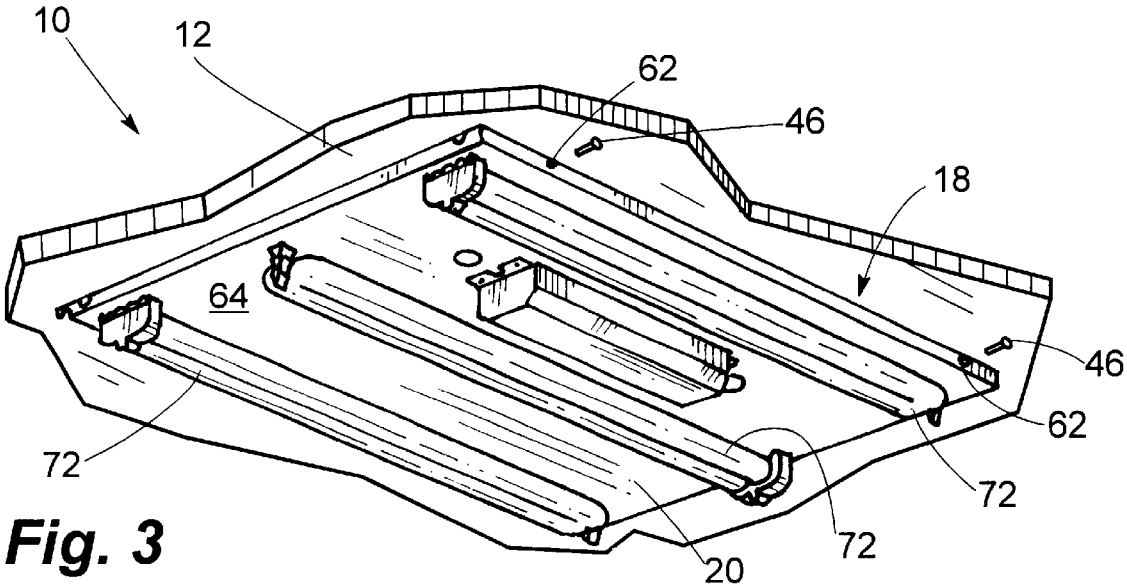
FIG. 3 is a perspective view of the mounting platform fixed to a ceiling.

The mounting platform 10 can be seen best in FIGS. 1 through 3 to be formed from a fixture housing 18 and a wireway cover 20, the housing 18 and the cover 20 being substantially alike in structure especially considering that the ultimate combination of the two essentially forms a box-like enclosure (as best seen in FIG. 3) which essentially constitutes the mounting platform 10.

The fixture housing 18 is essentially formed of a planar base 22 having upturned edges 24 and 26 which form depending walls or a depending skirt about the periphery of the base 22, the edges 24 being longer than the edges 26 in the event that the platform 10 is substantially rectangular. The fixture housing 18, as well as the wireway cover 20, is formed of painted steel in a manner which is essentially conventional when considering the manufacture of contemporary lighting fixtures. An opening 28 is formed substantially centrally of the base 22 to allow wiring 30 to be drawn from the junction box 16 and through the opening 28 for connection to wiring 32 which extends from electrical components mounted to the wireway cover 20 as will be described hereinafter. A ground wire 34 can also be pulled through the opening 28 from the junction box 16 and mounted in a conventional manner through aperture 36 such as by a screw 38 in order to ground the assembly. Apertures 40 are further formed one each essentially in the comers of the fixture housing 18, these apertures receiving fasteners (not shown) such as screws, toggle bolts or the like, which allow mounting of the fixture housing 18 directly to the ceiling 12. In most installations, the fixture housing 18 is mounted substantially flushly up against ceiling surfaces.

Figure 4:
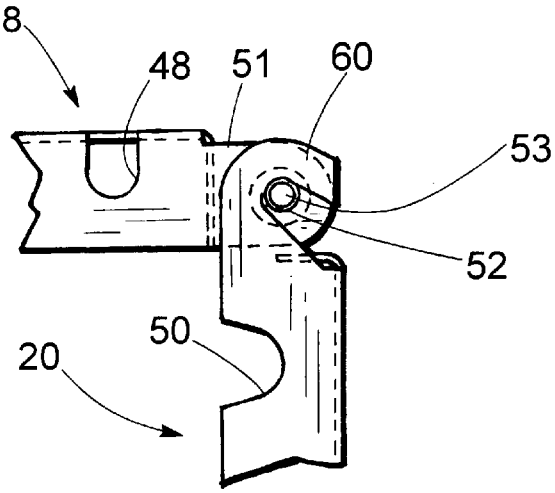
FIG. 4 is a detailed view of the pivoting mounting arrangement which connects the major portions of the platform together such as to allow installation as is seen in FIG. 2.

Hinges 42 are formed one each at ends of the edges 26 and extend beyond the edge 24 which is proximus to the hinges 42. This structure is seen in FIG. 4 in particular. The portion of the hinges 42 which are formed with the edges 26 of the fixture housing 18 are simple extensions of the edges 26 which are rounded at respective ends and which have an aperture 52, the ends of the edges 26 being shown at 51. The other edge 24 is provided with spaced openings 44 to receive screws 46 which hold the fixture housing 18 and the wireway cover 20 together as will be described hereinafter. The edges 24 are each provided with U-shaped notches 48 with one each of the notches being formed near each end of the edges 24. The notches 48 mate and align with similar notches 50 which are formed in the wireway cover 20 as will be described hereinafter.

The wireway cover 20 is substantially similar to the fixture housing 18 in that the cover 20 is formed of a planar base 54 having upturned edges 56 and 58 which essentially form short walls about the base 54. The edges 58 of the wireway cover 20 extend beyond one of the edges 56 along one side of the cover 20 to form respective hooks 60. As can particularly be seen in FIG. 4, screws 53 inserted one each into each aperture 52 in each end 51 of the edges 26 of the fixture housing 18 can have portions thereof received into bight portions of the hook 60, thereby to allow the wireway cover 20 to mount in a pivoting fashion to the fixture housing 18 once the housing 18 has been fixedly mounted to the ceiling 12. The wireway cover 20 thus hangs from the fixture housing 18 as is best seen in FIG. 2 so that an installer of the lighting fixture can pull the wiring 30 from the junction box 16 and connect that wiring to the corresponding wiring 32 which is carried by the wireway cover 20. Accordingly, the structure of the mounting platform 10 facilitates mounting of a lighting fixture in place without concerns which an installer must often consider in balancing a cover plate or similar heavy and electrical component-bearing structure during the connection of wiring.

One of the edges 56 of the wireway cover 20 is provided with openings 62 which mate with the openings 44 in the edges 24 of the fixture housing 18 once wiring is completed and the wireway cover 20 is pivoted into permanent position about the hinges 42, the openings 44 and 64 aligning to allow the screws 46 to connect the fixture housing 18 and the wireway cover 20 together to form a box-like enclosure which essentially encloses the wiring 30, 32 and provides a substantially flat platform at 64, the platform 64 being the exterior planar surface of the base 54. The platform 64 has various structure including electrical components mounted thereto including a ballast 66, lamp holder 68 and lamp mounts 70, the lamp holder 68 and the lamp mount 70 cooperating in a conventional manner to mount lamping 72 to the platform 64. Various openings (not shown for simplicity) are formed in the base 54 for mounting of the ballast, the lamp holder 68 and the lamp mount 70 inter alia with wiring from these elements extending interiorly of the enclosure formed by the combination of the fixture housing 18 and the wireway cover 20.

Figure 5:
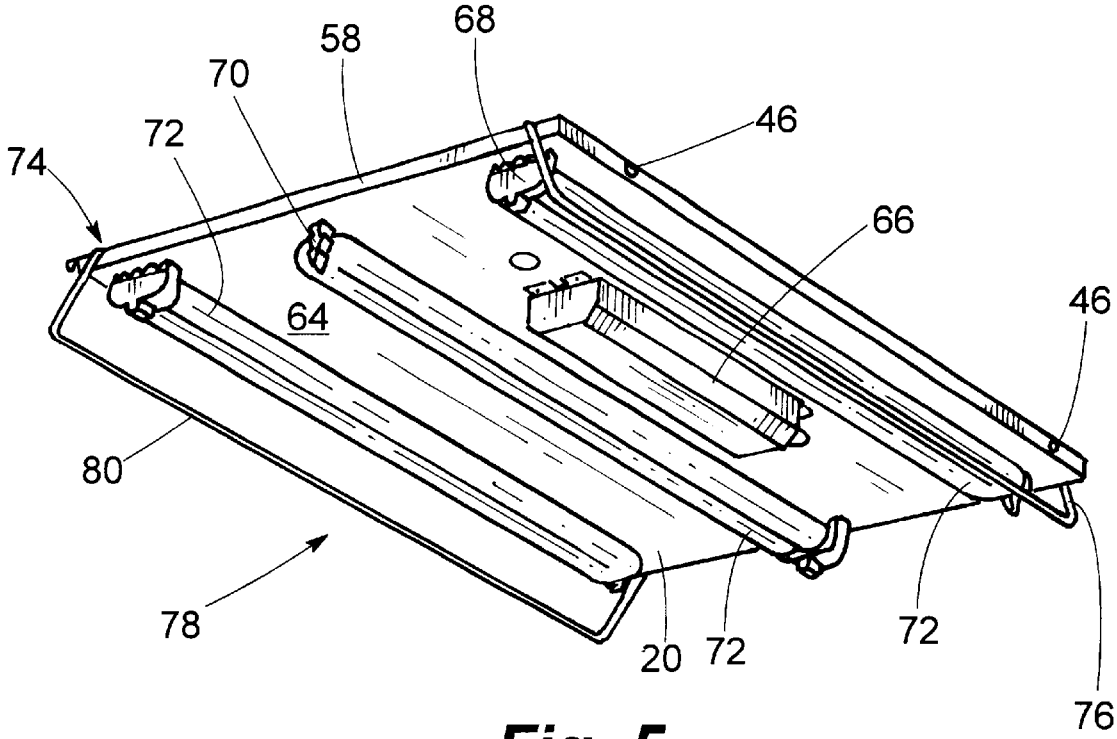
FIG. 5 is a detailed perspective view of pivotal hanger bars mounted to the mounting platform of the invention.

As has been previously indicated, the notches 50 are formed in the edges 58 of the wireway cover 20 and mate with the notches 48 formed in the edges 26 of the fixture housing 18, the notches 48 and 50 aligning on the pivoting of the housing 18 and the cover 20 together as is shown in FIG. 2 to produce the mounting platform 10 as is best seen in FIG. 3. The mounting platform 10 as seen in FIG. 3 exists with the notches 48 and the notches 50 aligned two each near each of the corners of the edges 26, 58. The aligned notches 48, 50 receive inwardly extending support pins 74 formed on legs 76 of hanger bars 78, the bars 78 being essentially U-shaped in conformation with a bight portion 80 extending between the oppositely spaced legs 76. Each end of the mounting platform 10 is provided with one of the hanger bars 78 as is seen in detail in FIG. 5.

Figure 6:
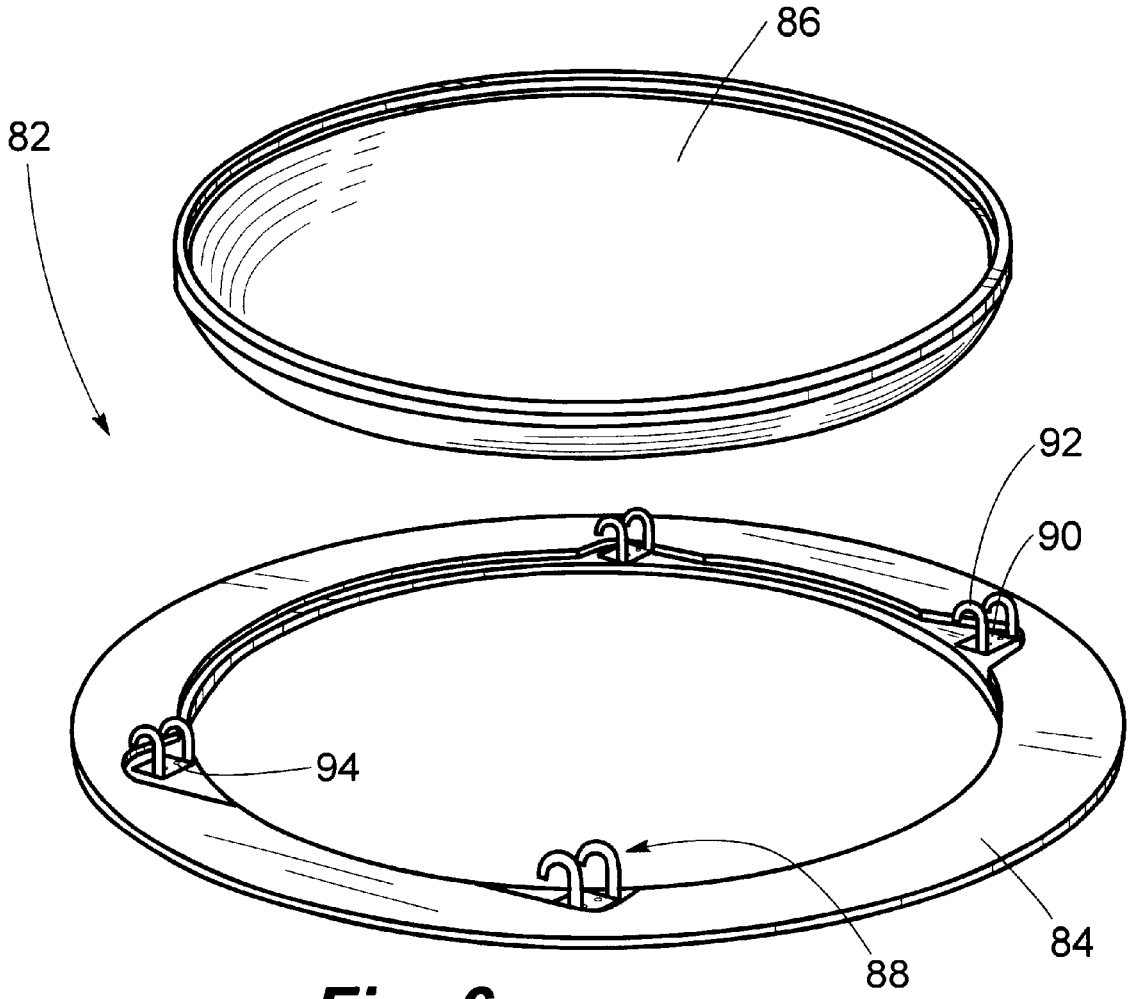
FIG. 6 is a perspective view of mounting brackets fixed to a trim frame of trim which can be mounted by the mounting platform of the invention.

Referring now to FIG. 6, it is to be seen that a trim 82 comprises a trim frame 84 and a diffuser 86. It is to be understood that the trim 82 can take a variety of shapes and sizes and still be mountable by the mounting platform 10 to form a lighting fixture according to the teachings of the present invention. On the underside of the trim frame 84, that is, at locations which will face the ceiling 12 once installed, aligned mounting brackets 88 are disposed two each near each end of the trim 82. The mounting brackets 88 are substantially formed of base portions 90 having dual hook elements 92 extending inwardly therefrom, the brackets 88 being mounted by means of screws 94 or the like to the trim frame 84.

Figure 7:
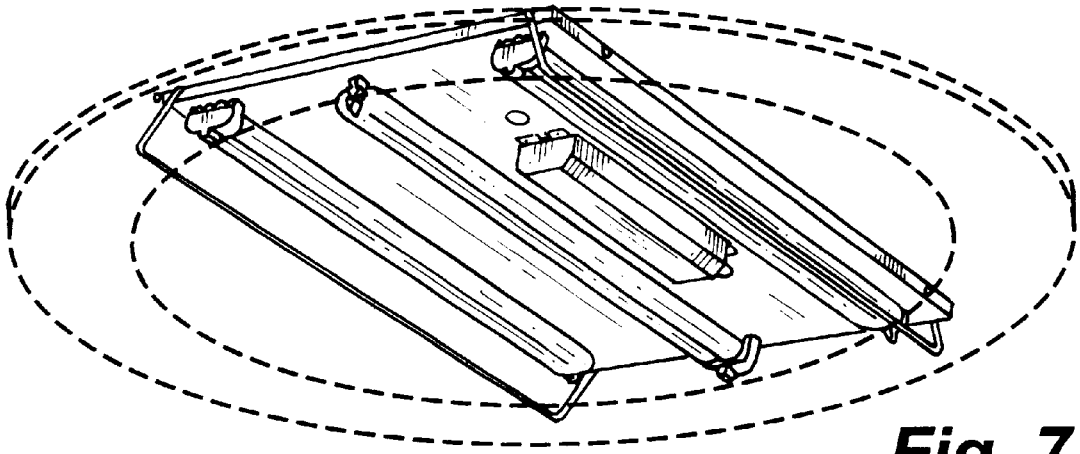
FIG. 7 is an assembly view in perspective of the lighting fixture whereby the trim is mounted to the mounting platform.
Figure 8:
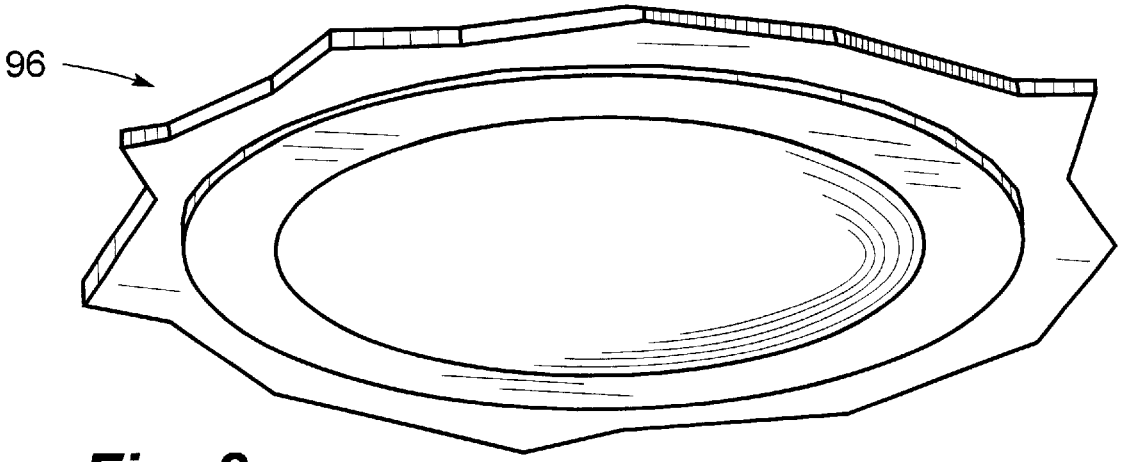
FIG. 8 is a perspective view of the lighting fixture of the invention seen when fully installed.

As can best be seen in FIG. 7, the trim 82 is installed on the mounting platform 10 once the diffuser 86 has been positioned on the trim frame 84. During this installation, two of the mounting brackets 88 at one end of the trim 82 are caused to connect by means of the hook elements 92 with the bight portion 80 of the hanger bars 78. Since the hanger bars 78 can be caused to pivot, the trim 82 is pushed toward one side of the mounting platform 10 with the opposite hanger bar 78 being pivoted so that engagement with the second hanger bar 78 can be made with the other pair of the mounting brackets 88 connected to the trim 82 at the other end of said trim. Accordingly, the trim 82 is mounted to the mounting platform 20 by means of the hanger bars 78 and takes the appearance seen in FIG. 8 of an installed lighting fixture 96. Although it is not necessary for the trim 82 to appear to "float" in spaced relation with the ceiling 12, the mounting arrangement described herein permits such an appearance without undue installation difficulty and expenditure of time.

Figure 9:
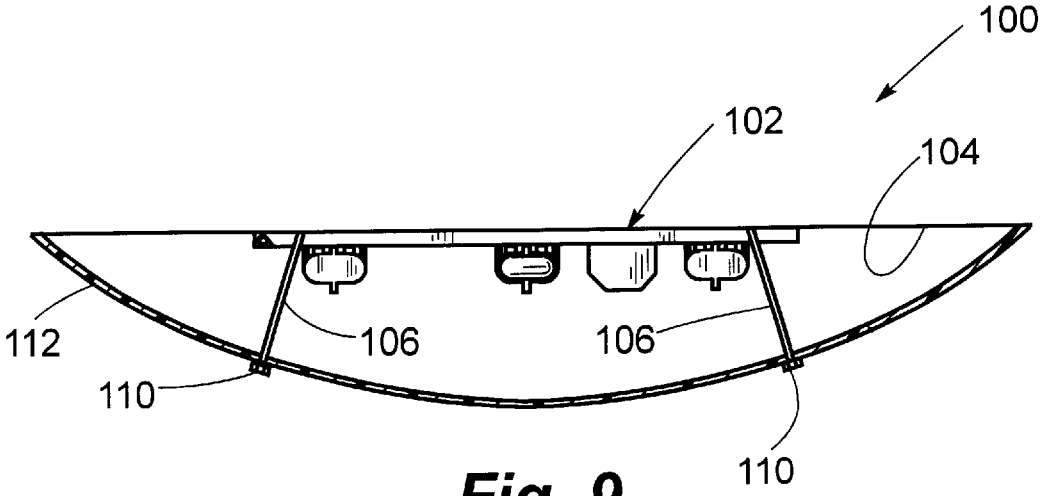
FIG. 9 is an elevational view of another embodiment of the invention whereby the trim can be tightened against a ceiling surface; and, FIG. 10 is an elevational view of yet another embodiment of the invention showing a trim rounded about its periphery and tightened against a ceiling surface.
Figure 10:
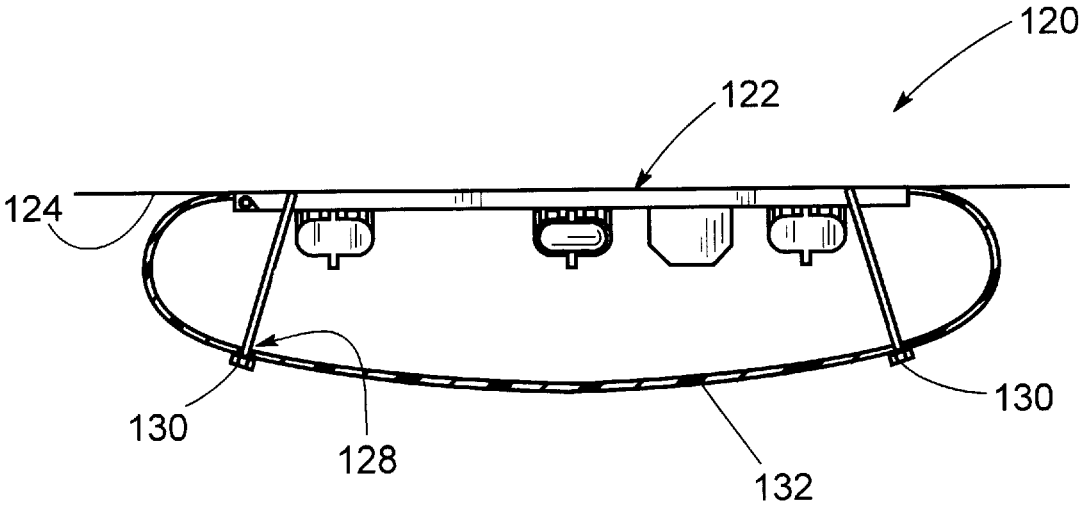

Referring now to FIGS. 9 and 10, lighting fixtures can be respectively seen at 100 and 120, trim 112 and 132 respectively being mounted to platforms 102 and 122 respectively by bars 106 and 128 respectively which terminate in threaded distal ends. The threaded distal ends of the bars 106 and 128 extend through apertures (not shown) formed respectively in the trim 112 and 132 and are held in place by nuts 110 and 130 respectively. The opposite ends of the bars 106 and 128 are mounted respectively by the platforms 102 and 122 in a manner similar to mounting of the hanger bars 78 of FIGS. 1 through 8. Tightening of the nuts 110 or 130 causes the respective trim 112 or 132 to be pulled upwardly to position flush against the ceilings 104 and 124 in order to provide a flush-mounted conformation desired by many users in view of appearance sake.

While the invention has been described relative to an explicit structure mounted to a particular environmental surface, that is, a drywall ceiling, it is to be understood that the invention can be configured other than as described explicitly herein without departing from the scope of the invention, the scope of the invention being determined by the definitions of the appended claims.

What is claimed is:

1. A surface-mounted lighting fixture mountable to an electrical box recessed at least partially in a ceiling, the electrical box containing wiring connected to a source of power, the ceiling defining a plane having a surface opposing an environmental space which is to be illuminated by the fixture, the fixture further having lamping and associated electrical components necessary for operation of the lamping, comprising:

a mounting platform having an outwardly facing surface on which the lamping and the associated electrical components are mounted, the mounting platform comprising a first plate-like element having depending side walls and a second plate-like element having depending side walls, the first plate-like element having an opening formed therein through which wiring from the electrical box extends, the first plate-like element being fixed permanently to the surface of the ceiling below the plane of the ceiling with the opening formed in the first plate-like element being disposed in the vicinity of the electrical box;

means carried by the platform on respective adjacent edges of the first and second plate-like elements for hinging the plate-like elements together for pivotal movement of the plate-like elements relative to each other, the second plate-like element being pivotal about an axis of the hinge means to an orientation permitting access to the wiring from the electrical box to allow connection of said wiring to wiring of the electrical components carried by the second plate-like element, the second plate-like element being pivotable into engagement with the first plate-like element to enclose at least portions of said wiring once said wiring is connected together;

means carried by the platform for connecting the first and second plate-like elements together on pivotal motion of said elements together to enclose said wiring;

mounting bars pivotally mounted to the mounting platform, each bar having a U-shape with spaced legs, a bight portion and inwardly extending pins formed one each on each free end of each of the legs, the mounting platform having apertures formed therein for receiving each one of the pins, the mounting bars freely swinging relative to the platform;

a trim assembly having a trim frame; and, mounting brackets joined to the trim frame, bight portions of each one of the mounting bars being receivable by one each of the mounting brackets to mount the trim assembly over the mounting platform in spaced relation to the ceiling, mounting of the trim assembly being facilitated by freely pivotal movement of the mounting bars relative to the mounting platform, the trim assembly having an appearance of floating beneath the ceiling without visible support while preventing visualization of the mounting platform from locations within the environmental space beneath the trim assembly of the lighting fixture, the mounting platform mounting trim assemblies of varying shapes and sizes having varying placement of the mounting brackets on said trim assemblies by virtue of the freely pivotal movement of the mounting bars relative to the mounting platform, the freely pivotal movement of the mounting bars further permitting spacing of the trim assemblies at varying spacings from the ceiling.

2. The lighting fixture of claim 1 wherein notches formed in certain of the depending side walls of the plate-like elements align on connection of the plate-like elements together to receive the pins of the mounting bars for pivotal movement of the mounting bars relative to the mounting platform.

3. The lighting fixture of claim 1 wherein the trim assembly further comprises a diffuser mountable to the trim frame.

4. The lighting fixture of claim 1 wherein the lamping comprises fluorescent lamps.

5. The lighting fixture of claim 4 wherein the associated electrical components comprise a ballast mounted to the outwardly facing surface of the mounting platform.

6. The lighting fixture of claim 4 wherein at least one lamp holder is mounted to the outwardly facing surface of the mounting platform.

7. The lighting fixture of claim 1 wherein the plate-like elements are formed of coated steel.

8. The lighting fixture of claim 1 wherein the ceiling is a drywall ceiling.

9. The lighting fixture of claim 1 wherein lengths of the bight portions of the mounting bars are greater than lengths of the spaced legs of the mounting bars.

10. The lighting fixture of claim 9 wherein the bight portion of each of the mounting bars extends fully across the mounting platform between opposing pairs of adjacent side walls of the first and second plate-like elements.

11. The lighting fixture of claim 1 wherein the mounting bars are disposed exteriorly of the mounting platform.

* * * * *